US012557948B2

(12) United States Patent
Somera

(10) Patent No.: US 12,557,948 B2
(45) Date of Patent: Feb. 24, 2026

(54) TOILET SEAT LIFT DEVICE

(71) Applicant: Charlyne Somera, New Braunfels, TX (US)

(72) Inventor: Charlyne Somera, New Braunfels, TX (US)

( * ) Notice: Subject to any disclaimer, the term of this patent is extended or adjusted under 35 U.S.C. 154(b) by 77 days.

(21) Appl. No.: 18/442,860

(22) Filed: Feb. 15, 2024

(65) Prior Publication Data

US 2025/0261809 A1 Aug. 21, 2025

(51) Int. Cl.
*A47K 13/10* (2006.01)

(52) U.S. Cl.
CPC ..... *A47K 13/10* (2013.01)

(58) Field of Classification Search
CPC ..... A47K 13/10
See application file for complete search history.

(56) References Cited

U.S. PATENT DOCUMENTS

| | | | | |
|---|---|---|---|---|
| 4,150,446 | A * | 4/1979 | Crocker | A47K 13/10 4/272 |
| 7,134,150 | B2 | 11/2006 | Stewart | |
| 7,281,277 | B1 | 10/2007 | Uchida | |
| D641,458 | S | 7/2011 | Mixon | |
| 8,230,529 | B1 * | 7/2012 | Reid | A47K 13/10 4/246.5 |
| 10,098,512 | B1 * | 10/2018 | Premchand | A47K 13/24 |
| 2006/0021122 | A1 | 2/2006 | Bruner | |
| 2006/0041997 | A1 | 3/2006 | Kist | |
| 2008/0307572 | A1 | 12/2008 | Leutschaft | |
| 2009/0100581 | A1 | 4/2009 | Mixon | |

FOREIGN PATENT DOCUMENTS

| | | |
|---|---|---|
| CA | 2617249 | 9/2008 |

* cited by examiner

*Primary Examiner* — Christine J Skubinna

(57) ABSTRACT

A toilet seat lift device for hands-free lifting and lowering of a toilet seat includes a toilet having a bowl and a seat. The seat is pivotably coupled to the bowl. The seat is pivotable between a raised position and a lowered position. The device further includes a pedal and an arm that is coupled to and extends between the seat and the pedal. Pressure on the pedal lifts the seat into the raised position. The seat pivots into the lowered position when pressure is removed from the pedal.

14 Claims, 7 Drawing Sheets

TOILET SEAT LIFT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lift mechanisms and more particularly pertains to a new lift mechanism for hands-free lifting and lowering of a toilet seat.

(2) Description of Related Art including information disclosed under 37 CFR 1.97 and 1.98

The prior art relates to lift mechanisms. The prior art discloses various lift mechanisms for raising a toilet seat. However, such devices often leave the toilet seat in a raised position after a user is finished using the toilet. When a subsequent user tries to sit down on the toilet, they may fall into the bowl of the toilet because the seat is in the raised position. This can be an extremely uncomfortable and unsettling experience. Thus, there is a need in the art for a toilet seat lift mechanism that will also lower the seat after the user is finished.

BRIEF SUMMARY OF THE INVENTION

An embodiment of the disclosure meets the needs presented above by generally comprising a toilet having a bowl and a seat. The seat is pivotably coupled to the bowl. The seat is pivotable between a raised position and a lowered position. The embodiment further comprises a pedal and an arm that is coupled to and extends between the seat and the pedal. Pressure on the pedal lifts the seat into the raised position. The seat pivots into the lowered position when pressure is removed from the pedal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
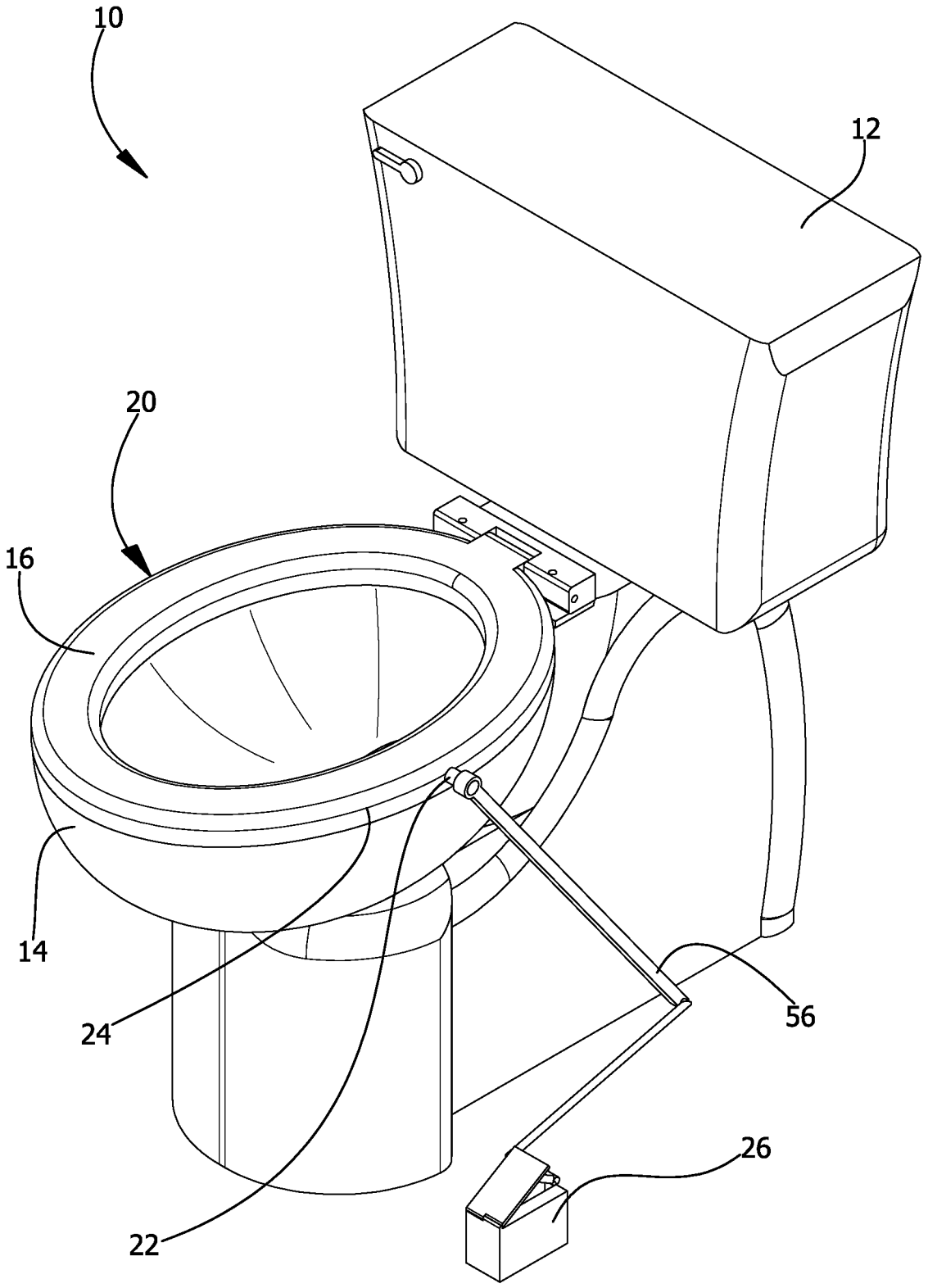
FIG. 1 is a top front isometric view of a toilet seat lift device according to an embodiment of the disclosure.
Figure 2:
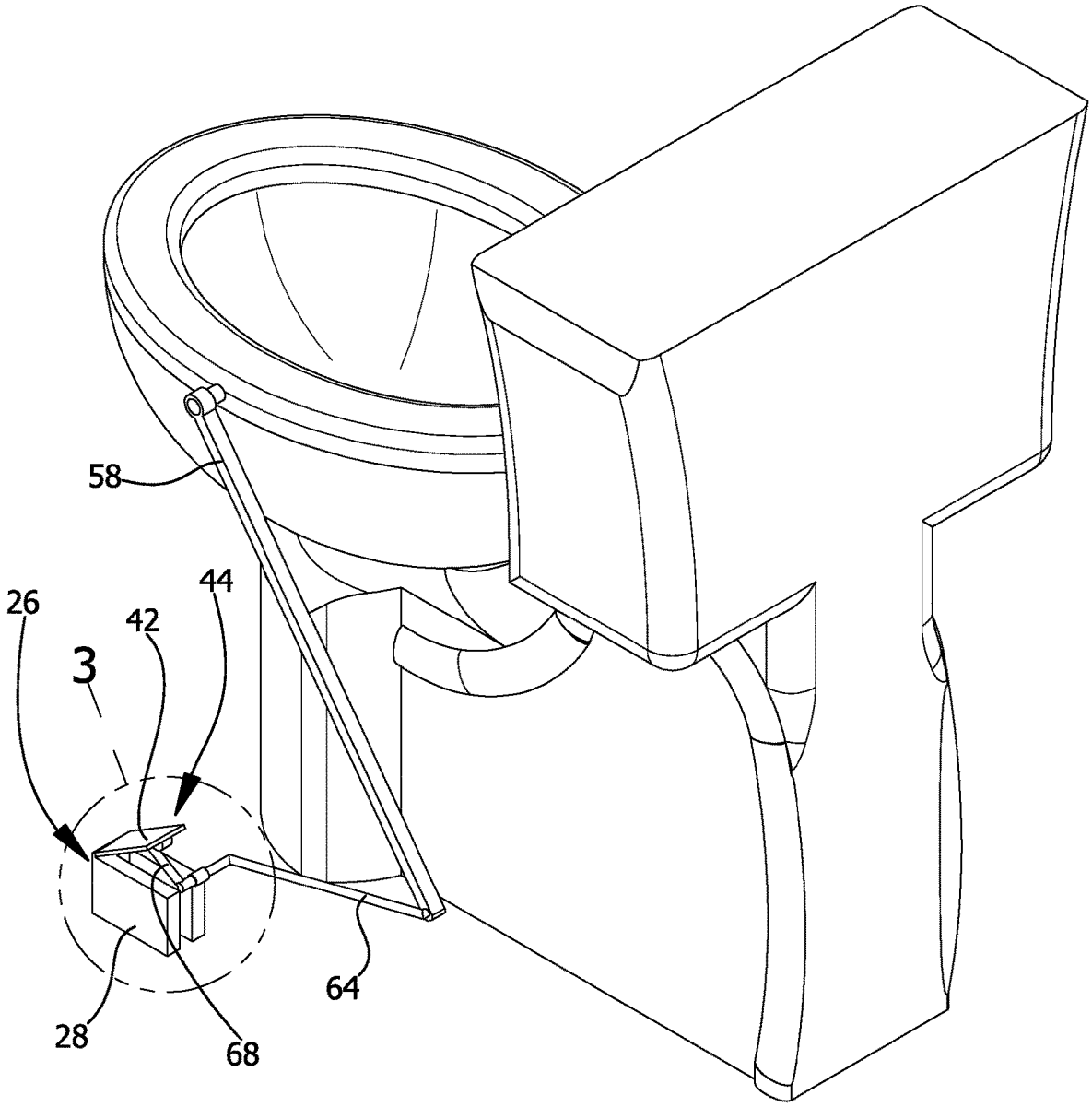
FIG. 2 is a top rear isometric view of an embodiment of the disclosure.

With reference now to the drawings, and in particular to FIGS. 1 through 7 thereof, a new lift mechanism embodying the principles and concepts of an embodiment of the disclosure and generally designated by the reference numeral 10 will be described.

As best illustrated in FIGS. 1 through 7, the toilet seat lift device 10 generally comprises a toilet 12 having a bowl 14 and a seat 16. The seat 16 is pivotably coupled to the bowl 14. The seat 16 is pivotable between a raised position 18 and a lowered position 20.

An axle 22 may be coupled to and extend outwardly from a perimeter edge 24 of the seat 16. For example, the axle 22 may be positioned on a side of the seat 16 so that the axle 22 does not interfere with the movement of the seat 16 relative to the bowl 14. When the axle 22 is on the side of the seat 16, the axle 22 also does not interfere with the comfort of the seat 16, for example when a user 70 is sitting on the seat 16.

A pedal 26 is positioned proximate to the toilet 12. For example, the pedal 26 may be positioned on the same side of the toilet 12 as the axle 22, or in other words, the pedal 26 may be positioned beneath the axle 22.

The pedal may include a box 28 having a lower surface 30, an upper surface 32, and a peripheral surface 34 that is coupled to and extends between the lower surface 30 and the upper surface 32. The lower surface 30 is generally flat so that the box 28 is stabilized while resting on the floor next to the toilet 12. The box 28 generally has a front side 36, a back side 38, and a pair of lateral sides 40 that is coupled to and extends between the front side 36 and the back side 38.

A plate 42 may be pivotably coupled to the upper surface 32 of the box 28. The plate 42 is pivotable between an elevated position 44 and a depressed position 46. Generally, pressure on the plate 42 lowers the plate 42 into the depressed position 46. The plate 42 may contact the upper surface 32 when the plate 42 is in the depressed position 46. The plate 42 pivots into the elevated position 44 when pressure is removed from the plate 42. The plate 42 is configured for manipulation by a foot 72 of the user 70.

A hinge 48 may pivotably couple the plate 42 to the upper surface 32. For example, the hinge 48 may be positioned at a top edge 37 of the front side 36 of the box 28. The hinge may bias the plate 42 in the elevated position 44 whereby the plate 42 pivots into the elevated position 44 when pressure is removed from the plate 42.

Figure 3:
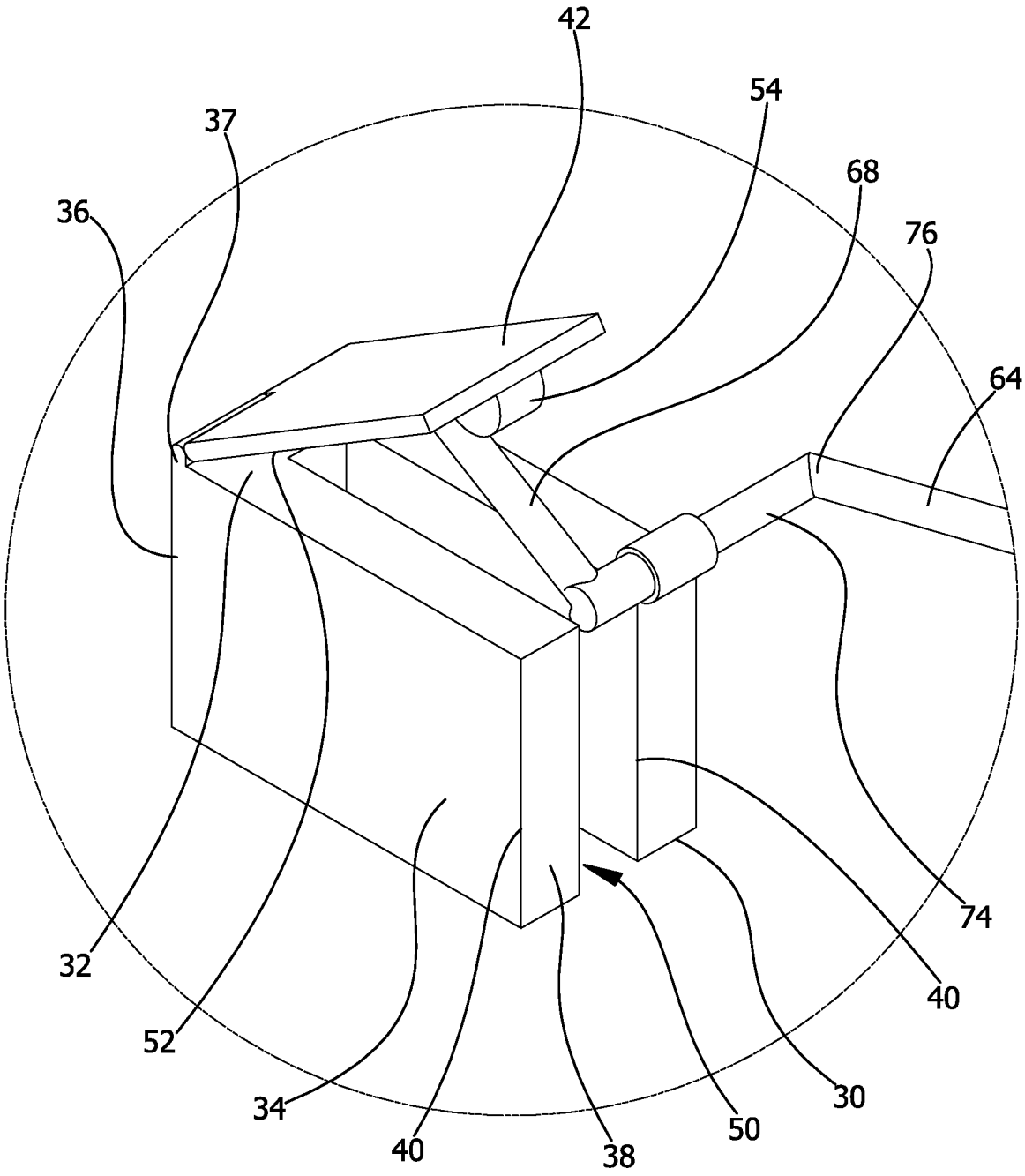
FIG. 3 is a detail view of an embodiment of the disclosure.
Figure 4:
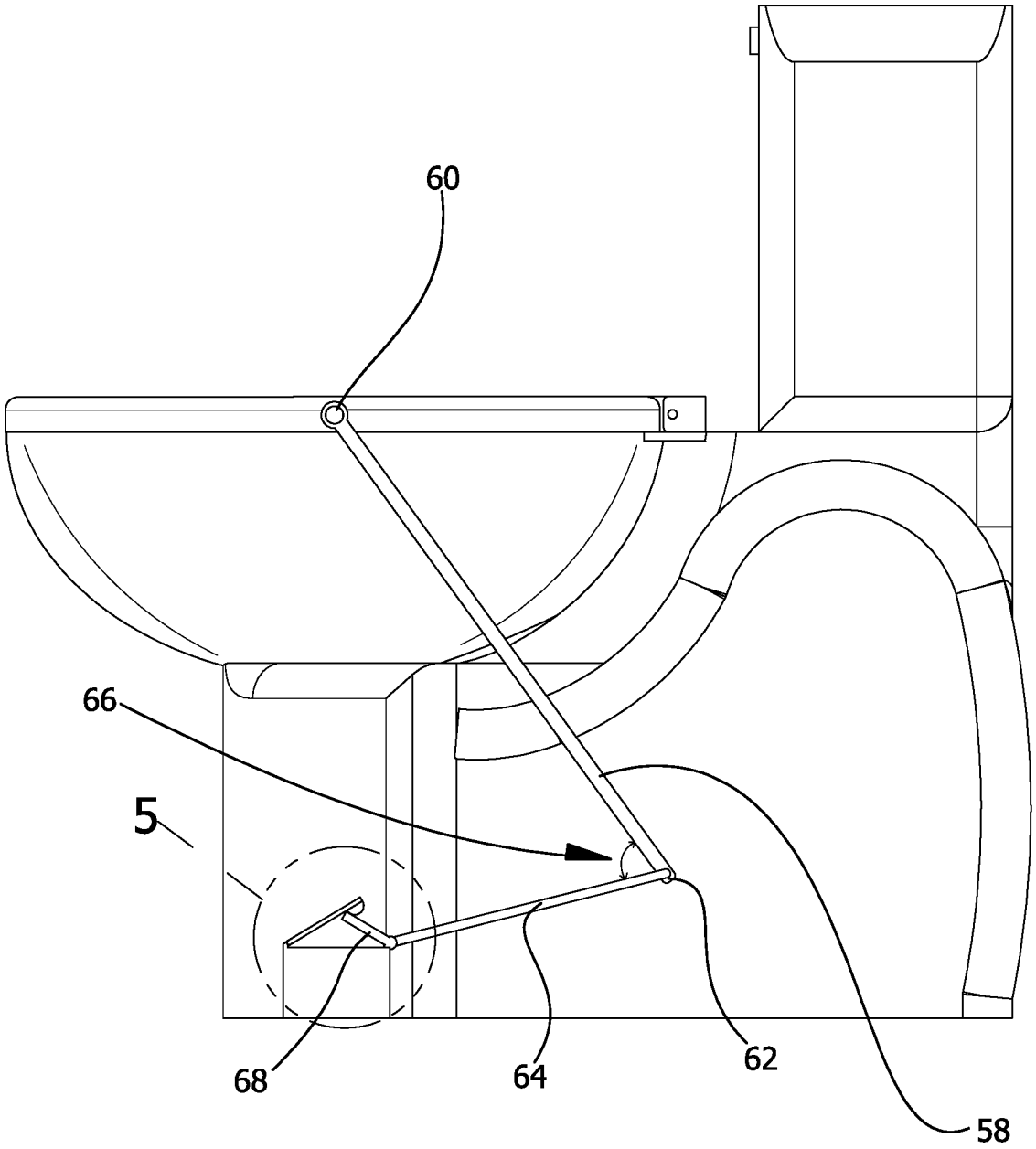
FIG. 4 is a side view of an embodiment of the disclosure.

A channel 50 may extend into the back side 38 of box 28 through each of the peripheral surface 24, the lower surface 30, and the upper surface 32. As shown in FIG. 3, the channel 50 may be aligned with the pair of lateral sides 40. The channel 50 may have an inner edge 52 that is spaced from the top edge 37 of the front side 36 of the box 28.

Figure 5:
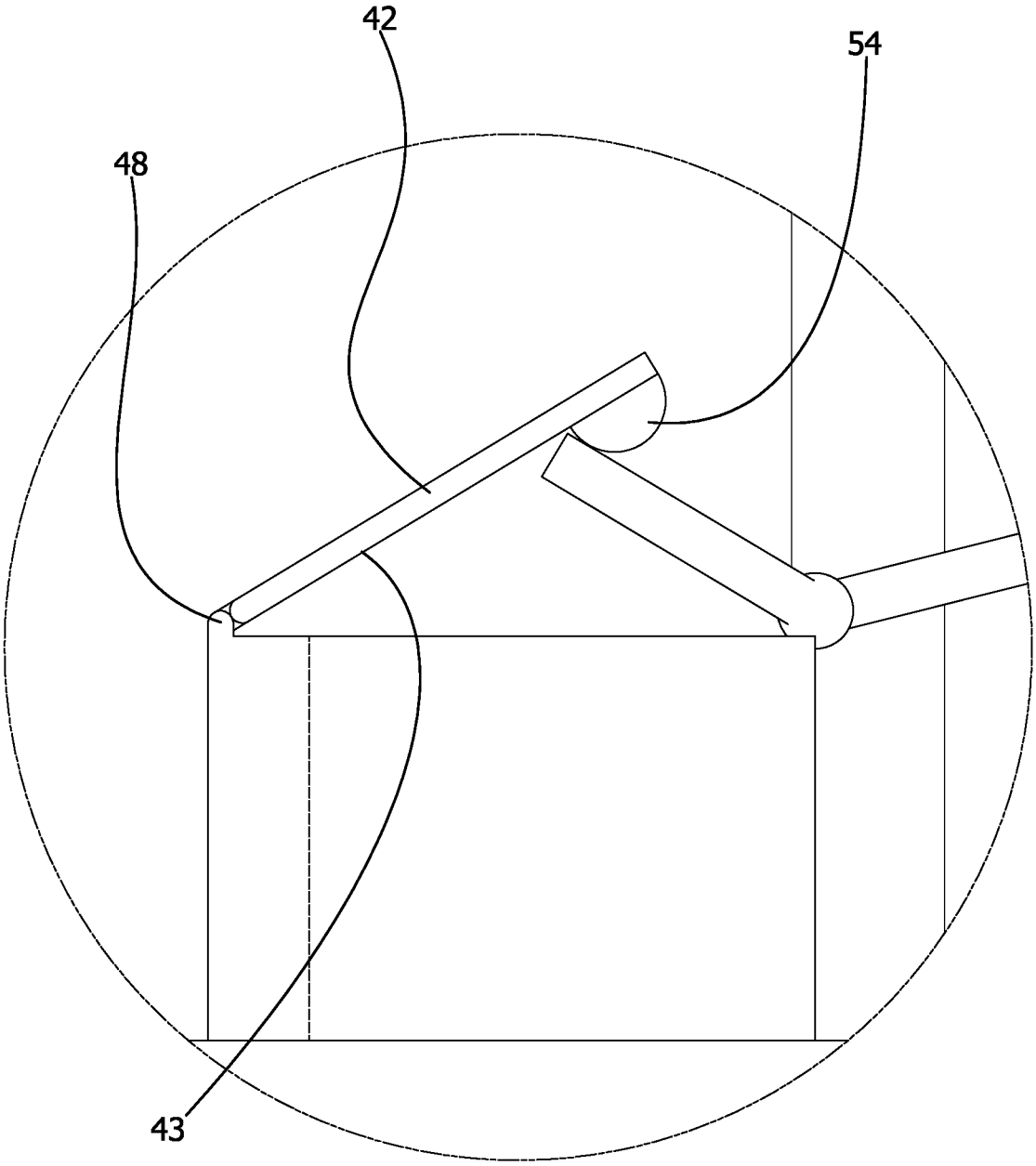
FIG. 5 is a detail view of an embodiment of the disclosure.
Figure 6:
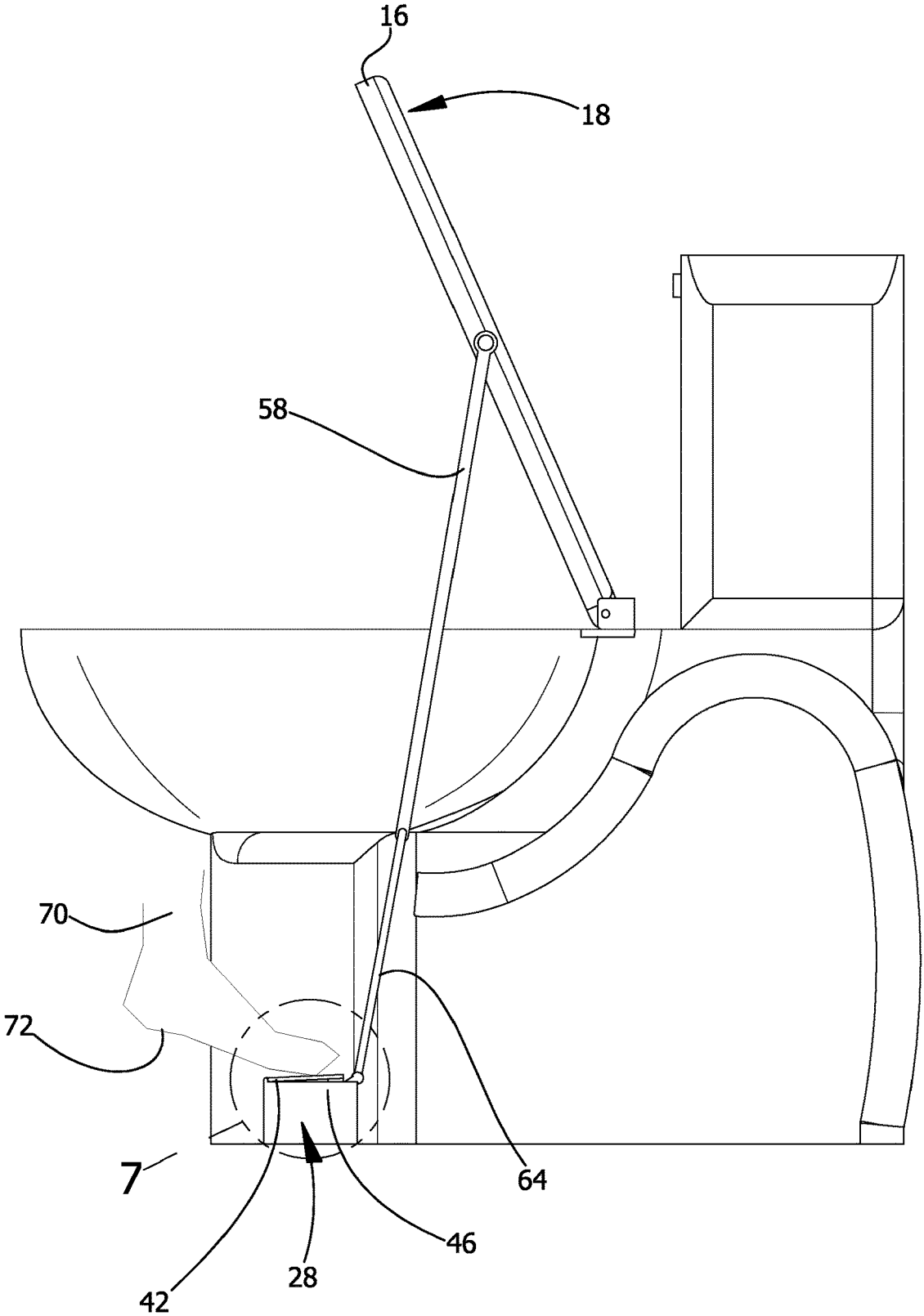
FIG. 6 is a side view of an embodiment of the disclosure.
Figure 7:
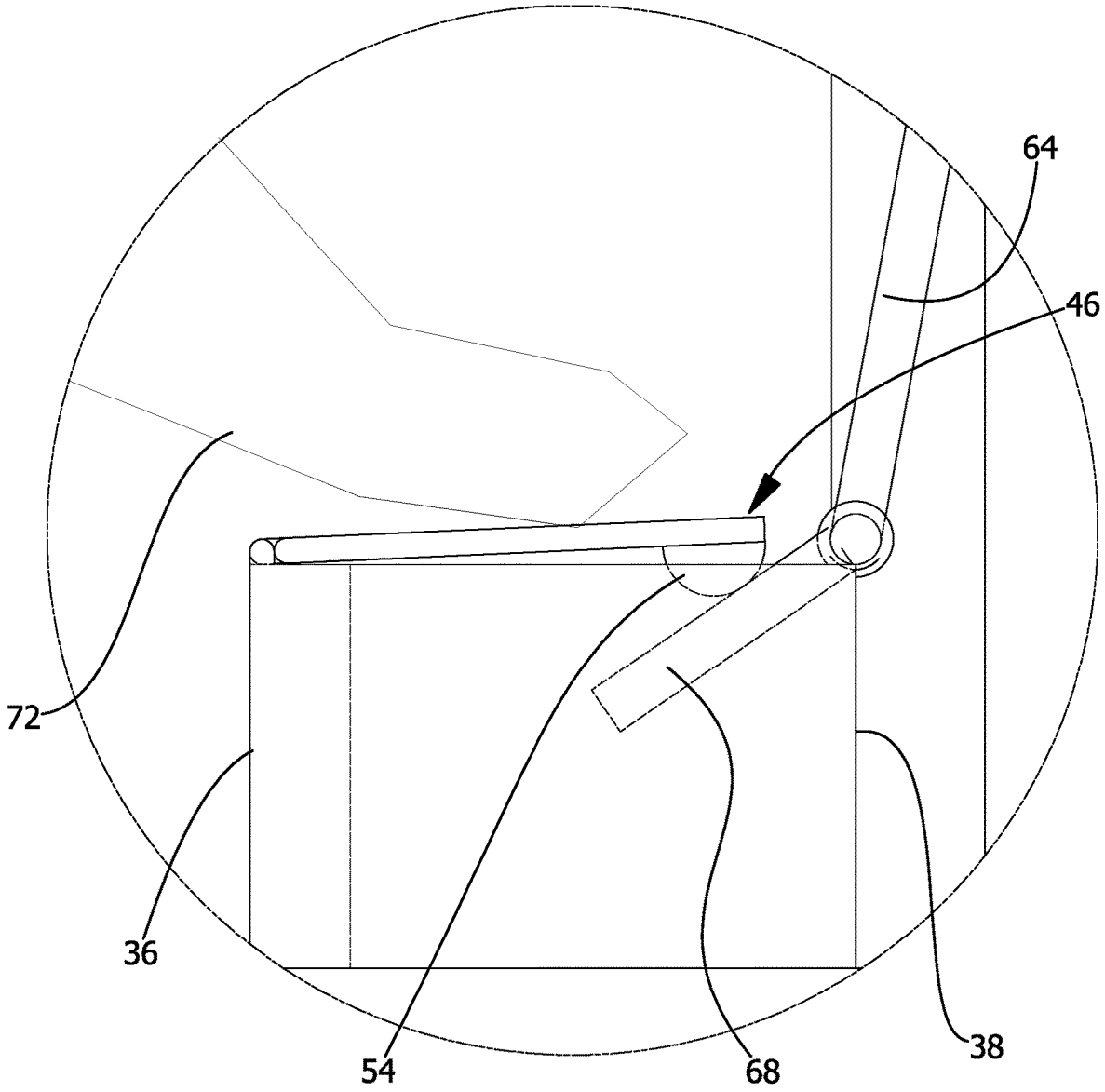
FIG. 7 is a detail view of an embodiment of the disclosure.

A knob 54 may be coupled to and extend downwardly from a bottom face 43 of the plate 42. The knob 54 is generally positioned within the channel 50 when the plate 42 is in the depressed position 46. In some embodiments, the knob may have a half-cylinder shape, as shown in FIG. 5.

An arm 56 is coupled to and extends between the seat 16 and the pedal 26. Pressure on the pedal 26 lifts the seat 16 into the raised position 18. The seat 16 pivots into the lowered position 20 when pressure is removed from the pedal 26. For example, the weight of the arm 56 may pull the seat 16 downward into the lowered position 20 when pressure is removed from the pedal 26. The weight of the seat 16 may also urge the seat 16 back to the lowered position 20 when pressure on the pedal 26 is removed.

Embodiments of the arm 56 may further comprise a first section 58 having a first end 60 and a second end 62. The first end 60 may be coupled to the axle 22 extending outwardly from the seat 16, and the axle 22 may extend through the first end 60. In other embodiments, the first end 60 may be coupled to the seat 16.

A second section 64 is pivotably coupled to the second end 62 of the first section 58. The second section 64 may be aligned with the first section 58 when the seat 16 is in the raised position 18. The first section 58 and second section 64 may form an acute angle 66 when the seat 16 is in the lowered position 20. A bar 74 may be coupled to and extend outwardly from a bottom end 76 of the second section 64. The bar 74 may be perpendicular to the second section 64.

A third section 68 may be pivotably coupled to the second section 64 distal to the second end 62 of the first section 58. For example, the third section 68 may be coupled to and extend upwardly from the bar 74 coupled to the bottom end 76 of the second section 64. The third section 68 is generally in contact with the pedal 26, for example touching the knob 54 on the bottom face 43 of the plate 42. The plate 42 may push the third section 68 downwardly into the channel 50 when pressure is applied to the plate 42. The third section 68 pivots the second section 64 into alignment with the first section 58 when pressure is applied to the plate 42 whereby the plate 42 is pivoted downwardly into the depressed position 46 and the seat 16 is pivoted upwardly into the raised position 18.

The arm 56 may pivot relative to the seat 16 when the arm 56 moves the seat 16 into the raised position 18. The arm 56 may pivot relative to the seat 16 when the seat 16 moves into the lowered position 20. For example, the arm 56 may pivot around the axle 22 that extends outwardly from the perimeter edge 24 of the seat 16.

In use, the user 70 may press the pedal 26 while standing in front of the toilet 12. The pedal 26 will move the arm 56 to raise the seat 16 to the raised position 18, exposing the bowl 14. Once the user 70 is finished using the toilet 12, the user 70 can remove the foot 72 from the pedal 26. The plate 42 will then pivot to the elevated position 44, and the arm 56 will lower as the seat 16 pivots downwardly to the lowered position 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lift system comprising:

a toilet having a bowl and a seat, the seat being pivotably coupled to the bowl, the seat being pivotable between a raised position and a lowered position;

a pedal, the pedal including:

a box having a lower surface, an upper surface, and a peripheral surface being coupled to and extending between the lower surface and the upper surface;

a plate being pivotably coupled to the upper surface, the plate being pivotable between an elevated position and a depressed position, wherein pressure on the plate lowers the plate into the depressed position;

a channel extending into the back side of box through the peripheral surface, the lower surface, and the upper surface; and a knob being coupled to and extending downwardly from a bottom face of the plate, the knob being positioned within the channel when the plate is in the depressed position; and an arm being coupled to and extending between the seat and the pedal, wherein pressure on the pedal lifts the seat into the raised position, the seat pivoting into the lowered position when pressure is removed from the pedal.

2. The lift system of claim 1, further comprising an axle being coupled to and extending outwardly from a perimeter edge of the seat.

3. The lift system of claim 2, wherein the axle is positioned on a side of the seat.

4. The lift system of claim 2, wherein the pedal is positioned proximate to the toilet and is aligned with the axle.

5. The lift system of claim 1, wherein the plate pivots into the elevated position when pressure is removed from the plate.

6. The lift system of claim 1, wherein the plate is configured for manipulation by a foot of a user.

7. The lift system of claim 1, wherein the knob has a half-cylinder shape.

8. The lift system of claim 1, the box further comprising a front side, a back side, and a pair of lateral sides being coupled to and extending between the front side and the back side, wherein the channel has an inner edge being spaced from the front side of the box.

9. The lift system of claim 8, further comprising a hinge pivotably coupling the plate to the upper surface, the hinge being positioned on the front side of the box.

10. The lift system of claim 1, the arm further comprising:

a first section having a first end and a second end, the first end being coupled to the seat;

a second section being pivotably coupled to the second end of the first section, the second section being aligned with the first section when the seat is in the raised position; and a third section being pivotably coupled to the second section distal to the second end of the first section, the third section being in contact with the pedal wherein the pedal pushes the third section downwardly and the third section pivots the second section into alignment with the first section whereby the seat is pivoted upwardly into the raised position.

11. The lift system of claim 10, wherein the first section and second section form an acute angle when the seat is in the lowered position.

12. The lift system of claim 1, wherein the arm pivots relative to the seat when the arm moves the seat into the raised position.

13. The lift system of claim 1, wherein the arm pivots relative to the seat when the seat moves into the lowered position.

14. A lift system comprising:

a toilet having a bowl and a seat, the seat being pivotably coupled to the bowl, the seat being pivotable between a raised position and a lowered position;

an axle being coupled to and extending outwardly from a perimeter edge of the seat, the axle being positioned on a side of the seat;

a pedal being positioned proximate to the toilet beneath the axle, the pedal comprising:

a box having a lower surface, an upper surface, and a peripheral surface being coupled to and extending between the lower surface and the upper surface, the box having a front side and a back side;

a plate being pivotably coupled to the upper surface, the plate being pivotable between an elevated position and a depressed position, wherein pressure on the plate lowers the plate into the depressed position, the plate contacting the upper surface when the plate is in the depressed position, the plate pivoting into the elevated position when pressure is removed from the plate, the plate being configured for manipulation by a foot of a user;

a hinge pivotably coupling the plate to the upper surface, the hinge being positioned at a top edge of the front side of the box;

a channel extending into the back side of box through the peripheral surface, the lower surface, and the upper surface, the channel having an inner edge being spaced from the top edge of the front side of the box;

a knob being coupled to and extending downwardly from a bottom face of the plate, the knob being positioned within the channel when the plate is in the depressed position, the knob having a half-cylinder shape;

an arm being coupled to and extending between the seat and the pedal, wherein pressure on the pedal lifts the seat into the raised position, the seat pivoting into the lowered position when pressure is removed from the pedal, the arm further comprising:

a first section having a first end and a second end, the first end being coupled to the axle, the axle extending through the first end;

a second section being pivotably coupled to the second end of the first section, the second section being aligned with the first section when the seat is in the raised position, the first section and second section forming an acute angle when the seat is in the lowered position; and a third section being pivotably coupled to the second section distal to the second end of the first section, the third section being in contact with the knob wherein the plate pushes the third section downwardly into the channel when pressure is applied to the plate and wherein the third section pivots the second section into alignment with the first section when pressure is applied to the plate whereby the plate is pivoted downwardly into the depressed position and the seat is pivoted upwardly into the raised position;

wherein the arm pivots relative to the seat when the arm moves the seat into the raised position; and wherein the arm pivots relative to the seat when the seat moves into the lowered position.

* * * * *